US007270045B1

(12) United States Patent
Gonzalez

(10) Patent No.: US 7,270,045 B1
(45) Date of Patent: Sep. 18, 2007

(54) SYSTEM AND METHOD FOR INDUCED ACCELERATION MITIGATION FOR SEAT OCCUPANT

(75) Inventor: Rene' G. Gonzalez, Southfield, MI (US)

(73) Assignee: United States of America as represented by the Secretary of the Army, Washington, DC (US)

( * ) Notice: Subject to any disclaimer, the term of this patent is extended or adjusted under 35 U.S.C. 154(b) by 354 days.

(21) Appl. No.: 11/117,409

(22) Filed: Apr. 29, 2005

(51) Int. Cl.
*F41H 5/00* (2006.01)

(52) U.S. Cl. ..... 89/36.02; 296/68.1; 180/271

(58) Field of Classification Search ..... 296/68.1, 296/65.09, 187.08, 193.07; 297/216.1, 216.15–216.17; 89/36.01–36.02, 36.04, 36.07–36.09; 180/271
See application file for complete search history.

(56) References Cited

U.S. PATENT DOCUMENTS

| | | | | |
|---|---|---|---|---|
| 3,198,288 | A * | 8/1965 | Presunka | 188/377 |
| 4,325,446 | A | 4/1982 | Hicks | |
| 4,696,508 | A | 9/1987 | Brautigam | |
| 5,039,155 | A | 8/1991 | Suman et al. | |
| 5,372,399 | A | 12/1994 | Ito et al. | |
| 5,451,094 | A * | 9/1995 | Templin et al. | 297/216.17 |
| 5,524,721 | A | 6/1996 | Yamauchi | |
| 5,662,376 | A * | 9/1997 | Breuer et al. | 297/216.2 |
| 5,758,859 | A | 6/1998 | Gonzalez | |
| 5,813,649 | A * | 9/1998 | Peterson et al. | 248/618 |
| 5,902,009 | A | 5/1999 | Singh et al. | |
| 5,961,182 | A | 10/1999 | Dellanno | |
| H001833 | H * | 2/2000 | Hoppel et al. | 296/68.1 |
| 6,179,380 | B1 * | 1/2001 | Hoffman | 297/216.17 |
| 6,186,256 | B1 | 2/2001 | Dignitti | |
| 6,267,440 | B1 | 7/2001 | Hoffman | |
| 6,338,368 | B1 | 1/2002 | Hassell | |
| 6,431,300 | B1 * | 8/2002 | Iwase | 180/68.5 |
| 6,688,089 | B2 | 2/2004 | Velke et al. | |
| 6,805,033 | B2 | 10/2004 | Mauthe et al. | |
| 6,851,747 | B2 | 2/2005 | Swierczewski | |
| 7,014,002 | B2 * | 3/2006 | Mizuta | 180/68.5 |
| 7,055,893 | B2 * | 6/2006 | Yamamura et al. | 296/187.08 |
| 2002/0157886 | A1 * | 10/2002 | Iwase | 180/68.5 |
| 2006/0076809 | A1 * | 4/2006 | Ravid et al. | 297/216.1 |

* cited by examiner

*Primary Examiner*—Dennis H. Pedder
*Assistant Examiner*—Mike Hernandez
(74) *Attorney, Agent, or Firm*—David L. Kuhn; Thomas W. Saur; Luis Miguel Acosta

(57) ABSTRACT

A system for mitigation of induced acceleration to an occupant of a vehicle seat includes a substantially non-deforming structure having a top side with the vehicle seat mounted thereon and a bottom side forming a first portion of a floor of the vehicle, and at least one deformable bracket mounting the non-deforming structure to a second portion of the floor that is separate from the first portion of the floor. The at least one deformable bracket deforms, and the non-deforming structure extends through the floor when the vehicle is subjected to an upward force that is equal to or greater than a predetermined force that corresponds to an induced upward acceleration.

20 Claims, 2 Drawing Sheets

SYSTEM AND METHOD FOR INDUCED ACCELERATION MITIGATION FOR SEAT OCCUPANT

GOVERNMENT INTEREST

The invention described here may be made, used and licensed by and for the U.S. Government for governmental purposes without paying royalty to me.

BACKGROUND OF THE INVENTION

1. Field of the Invention

The present invention generally relates to a system and a method for mitigation of induced acceleration to an occupant of a vehicle seat.

2. Background Art

In order to provide an acceptable level of protection to vehicle occupants when the vehicle encounters an explosive event (e.g., a severe acceleration or shock to the vehicle, generally in an upward direction relative to the normal operating position of the vehicle) generated by a land mine, improvised explosive device (IED), and the like, measures are taken to reduce probability and severity of occupant injuries. Many approaches to occupant acceleration reduction provide for the occupant to move downward (as the rest of the vehicle generally moves upward relative to the normal operating position of the vehicle) during the explosive event. The relative downward movement of the occupant typically limits shock loads or spreads the acceleration over an extended period of time relative to the explosive event, thus reducing loads and accelerations to the occupant.

In one example (a M-1114 High Mobility Multipurpose Wheeled Vehicle, HMMWV), a load limiting seat mounting bracket assembly is employed. The bracket assembly plastically deforms at a predetermined load (e.g., design limit). Any force in excess of the design limit moves the seat downward (relative to the normal operating orientation of the vehicle) against the resistive force of the deforming material, thus limiting the load transfer from the vehicle to the occupant to a predetermined maximum value (i.e., level, amount, etc.). The load limiting seat mounting bracket assembly is generally implemented as an "accordion" shaped deformable structure that provides cost, weight and space advantages over alternative conventional approaches.

On the HMMWV vehicle the batteries are located in a box beneath the right front (i.e., commander's) seat. As such, the load limiting seat mounting bracket assembly can not be effectively implemented when the batteries remain located at the normal position beneath the right front seat. Thus, on the M-1114 the battery box is relocated (i.e., lowered) to provide adequate clearance for implementation of the explosive event protective load limiting seat mounting bracket assembly. While lowering the battery container provides room for the seat movement when the seat bracket assembly deforms, lowering the battery container has the deficiency of negatively impacting the ground clearance of the vehicle and thus mobility of the vehicle. Further, lowering the battery container has an additional deficiency of being a more involved and complex procedure than is desirable for kit installation or retrofitting.

Thus, there exists a need and an opportunity for an improved system and a method for mitigation of induced acceleration (e.g., acceleration due to a land mine explosion and the like) to an occupant of a vehicle seat. Such an improved system and method may overcome one or more of the deficiencies of conventional approaches.

SUMMARY OF THE INVENTION

Accordingly, the present invention may provide an improved system and a method for mitigation of to induced acceleration (e.g., acceleration due to a land mine explosion and the like) an occupant of a vehicle seat. The improved system and method of the present invention generally overcome one or more of the deficiencies of conventional approaches while maintaining vehicle ground clearance and mobility and further providing cost, weight and space advantages over alternative conventional approaches.

According to the present invention, a system for mitigation of induced acceleration to an occupant of a vehicle seat is provided. The system comprises a substantially non-deforming structure having a top side with the vehicle seat mounted thereon and a bottom side forming a first portion of a floor of the vehicle, and at least one deformable bracket mounting the non-deforming structure to a second portion of the floor that is separate from the first portion of the floor. The at least one deformable bracket deforms, and the non-deforming structure extends through the floor when the vehicle is subjected to an upward force that is equal to or greater than a predetermined force that corresponds to an induced upward acceleration.

Further, according to the present invention, a method of mitigation of induced acceleration to an occupant of a vehicle seat is provided. The method comprises mounting the vehicle seat to a top side of a substantially non-deforming structure, wherein the non-deforming structure has a bottom side forming a first portion of a floor of the vehicle, and mounting the non-deforming structure to a second portion of the floor that is separate from the first portion of the floor using at least one deformable bracket. The at least one deformable bracket deforms, and the non-deforming structure extends through the floor when the vehicle is subjected to an upward force that is equal to or greater than a predetermined force that corresponds to an induced upward acceleration.

The above features, and other features and advantages of the present invention are readily apparent from the following detailed descriptions thereof when taken in connection with the accompanying drawings.

DETAILED DESCRIPTION OF THE PREFERRED EMBODIMENT(S)

With reference to the Figures, the preferred embodiments of the present invention will now be described in detail. Generally, the present invention provides an improved system and an improved method for mitigation of an explosive event induced acceleration (e.g., a severe acceleration or shock, generally in an upward direction relative to the normal operating position of the vehicle generated by a land mine, an improvised explosive device (IED), a booby trap, and the like) to an occupant of a vehicle at a vehicle seat. The present invention may be advantageously implemented in connection with a M-1114 High Mobility Multipurpose Wheeled Vehicle (HMMWV). However, the present invention may be implemented in connection with any appropriate vehicle to meet the design criteria of a particular application.

In the description of the present invention, reference to directions (e.g., vertical, downward, front, etc.) is generally in relationship to (corresponds to) a normal operating orientation (or position) of the vehicle where the present invention is implemented.

Figure 1:
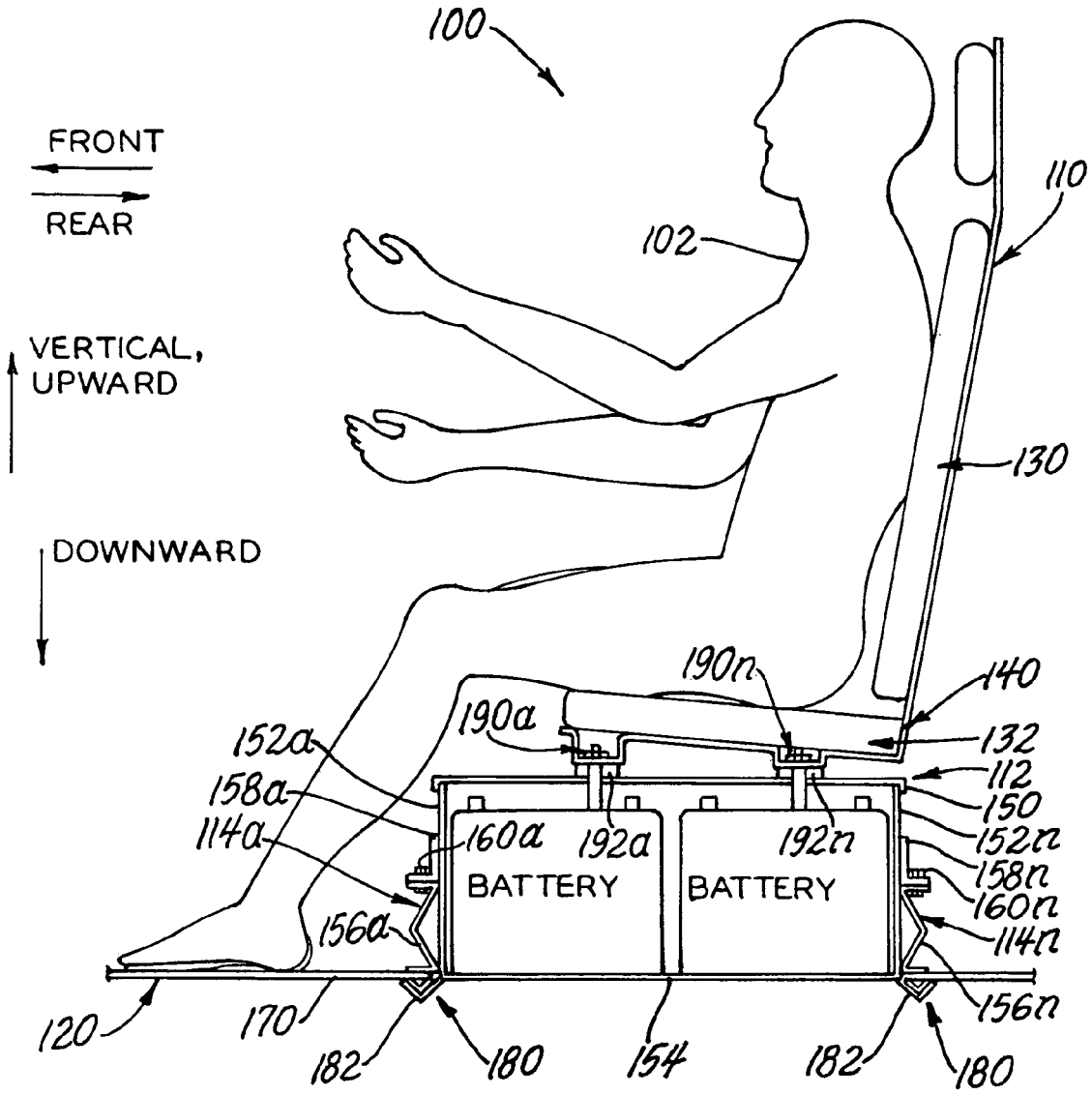
FIG. 1 is a diagram of a vehicle seat system according to the present invention prior to exposure to a severe shock event.

Referring to FIG. 1, a diagram illustrating a vehicle seat system 100 according to the present invention is shown. The vehicle seat system (e.g., apparatus, structure, assembly, etc.) 100 is generally mounted to the floor of a vehicle (total vehicle not shown). The seat system 100 generally comprises a seating arrangement for an occupant (e.g., rider, commander, driver, operator, passenger, user, etc.) 102 of the vehicle. The seat system 100 generally comprises a seat 110, a structure (e.g., container, box, bin, compartment, set of shelves, etc.) 112, and at least one (generally a plurality of) mounting bracket(s) 114 (e.g., brackets 114*a*-114*n*). The seat system 100 is generally mounted (i.e., fastened, fixed, assembled to, etc.) a vehicle floor 120. The occupant 102 is generally seated in seat 110.

The seat 110 generally comprises a back structure 130 and a bottom structure 132. The bottom structure 132 may include a cushion 140 that is generally removably fastened (e.g., fastened using hook and loop fasteners, snap fasteners, or the like) to a frame structure.

The structure 112 generally comprises a top side (i.e., portion, part, section, etc.) 150, a plurality (generally four) vertical sides 152 (e.g., sides 152*a*-152*n*), and a bottom side 154. In one example, the structure 112 may be implemented as a container, and the container 112 may be implemented as a battery box that contains (i.e., holds, carries, etc.) batteries for the vehicle where the system 100 is implemented. In another example (not shown), the container 112 may be implemented as a stowage or storage compartment. However, the structure 112 may be implemented as any appropriate substantially (or essentially) box-shaped structure to meet the design criteria of a particular application.

The mounting brackets 114 generally comprise respective deformable assemblies 156 (e.g., assemblies 156*a*-156*n*) that plastically deform at a predetermined load (e.g., a design limit, value, amount, level, force, acceleration, shock, etc.) and mounts 158 (e.g., mounts 158*a*-158*n*) that may be fastened together as the unit 114 using respective bolt/nut assemblies 160 (e.g., bolt/nut assemblies 160*a*-160*n*). In one example, the deformable assembly 156 may be implemented as an accordion-shaped (i.e., V-shaped, Z-shaped, zig-zaged, etc.) deformable structure. In another example (not shown), the deformable assembly 156 may be implemented as a convoluted (e.g., wave-shaped) deformable structure. However, the mounting brackets 114 may be implemented using deformable assemblies 156 having any appropriate apparatus, shape or structure to meet the design criteria of a particular application.

While the seat system 100 is illustrated having two mounting brackets 114 (i.e., a bracket 114*a* at the front of the seat 110, and a bracket 114*n* at the rear of the seat 110), the seat system 100 may be implemented having any appropriate number of mounting brackets 114 to meet the design criteria of a particular application (e.g., four brackets 114, one on each side of the seat 110, a single bracket 114 at the rear of seat 110, etc.).

The floor 120 generally comprises the structure (or container) 112 bottom portion 154 (i.e., a first portion), and a second portion 170. The second floor section 170 generally includes the floor 120 except for the section 154. As such, the first floor section 154 is generally separate from the second floor section 170 (e.g., the bottom portion 154 may comprise a filler for a hole in the second floor portion 170 of the floor 120).

To provide integrity of the floor 120, that is to reduce or prevent intrusion from dust, dirt, liquids, noise, fumes, etc. into the interior of the vehicle where the seat system 100 is implemented, a seal assembly 180 is generally implemented between the first floor section 154 and the second floor section 170.

Figure 2:
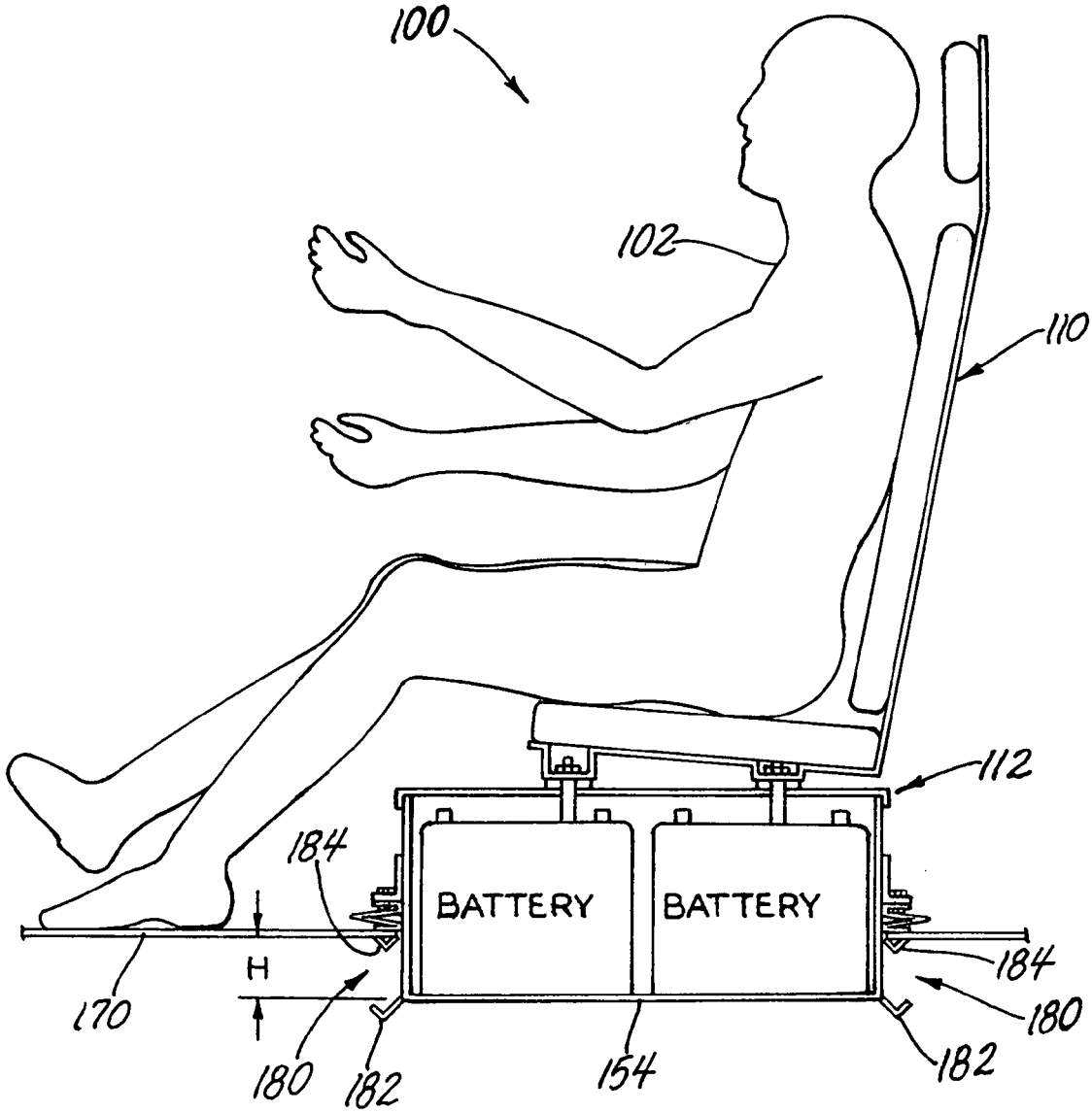
FIG. 2 is a diagram of a vehicle seat system according to the present invention after exposure to a severe shock event.

As shown in more detail in FIG. 2, in one example, the seal 180 may be implemented as a first portion 182 that is generally fastened to the first floor portion 154, and a second portion 184 that is generally fastened to the second floor portion 170. In another example (not shown), the seal 180 may be implemented as a one piece (generally tearable and replaceable) part that is fastened to the first floor portion 154 and to the second floor portion 170. In yet another example (not shown), the first seal portion 182 may be implemented as a resilient material that seals directly to the second floor portion 170, and the second seal portion 184 may be deleted. However, the seal 180 may be implemented as any appropriate sealing apparatus to meet the design criteria of a particular application.

To provide access to the interior of the container 112 (e.g., to service batteries held therein, to access material stored therein, etc.) in one example, the frame of the seat bottom 132 may be removably fastened to the vehicle at the container top 150 via threaded stud/hand-turned nut assemblies 190 (e.g., assemblies 190*a*-190*n*). Access to the nut portions of the assemblies 190 is generally provided by removal of the seat bottom 132 cushion. The stud portion of the assemblies 190 may extend through the lid 150, and may be fastened to the floor section 154.

In another example (not shown), access to the interior of the container 112 may be provided by having the seat 110 mounted directly to the container top 150 and having a hinge mechanism at an edge between the top 150 and a side 152, and having a latch mechanism at an opposing edge such that the seat/lid combination may be tilted. In yet another example (not shown), the container 112 may be implemented having one or more of the sides 152 partially or completely open or absent to provide access to the interior of the container 112. In yet another example (not shown), the container 112 may be implemented having one or more sliding drawers. However, access to the interior of the container 112 may be implemented via any appropriate apparatus or technique to meet the design criteria of a particular application.

Additional cushioning (e.g., vibration isolation, damping, transmission reduction, etc.) for the occupant 102 may be provided by respective resilient material (e.g., rubber, elastomer, urethane, plastic, etc.) buffers (i.e., flat washers, toroidial washers ("donuts"), etc.) 192 (e.g., buffers 192*a*-192*n*) positioned (i.e., disposed, placed, etc.) between the seat bottom frame 132 and the container lid 150 on respective studs of the assemblies 190.

Referring to FIG. 2, a diagram illustrating the system 100 after exposure to a severe shock event (e.g., an explosive event) is shown.

When the vehicle where the seat system 100 is implemented encounters an event (e.g., an explosion) that generates an upward force on the floor 120 at or above (i.e., equal to or greater than) the predetermined force, the at least one deformable assembly 156 generally deforms to mitigate the upward acceleration (or shock) of the severe upward force to the occupant 102. The structure 112 generally extends downward through the vehicle floor 120 a distance (i.e., amount, height, value, etc.) less than or equal to a distance, H.

However, the structure 112 does not generally deform (i.e., the structure 112 may be implemented as a substantially non-deforming structure). In particular, the vertical sides 152 may form a substantially (i.e., essentially, predominantly, etc.) rigid, non-deforming structure (or apparatus).

The height H may be selected (i.e., measured, calculated, determined, etc.) and the mounts 158 may be fastened to the sides 152 such that the height, H, of the container 112 that is extended through the floor 120 when the at least one deformable bracket 156 is fully deformed is less than the distance between the second portion of the floor 170 and a surface on which the vehicle normally operates (e.g., ground) when wheels and hubs are removed from the vehicle. Such a dimension, H, may ensure that the container 112 does not generally strike the surface on which the vehicle normally operates when the vehicle where the seat system 100 is implemented encounters an event that generates an upward force equal to or greater than the predetermined force.

As is apparent from the above detailed description, the present invention may provide an improved system and an improved method for a vehicle seating system. The present invention generally provides an improved system and an improved method for mitigation of induced acceleration to an occupant of a vehicle seat that is generated by an explosive event while maintaining normal vehicle floor to ground clearance and vehicle mobility, when compared to conventional approaches.

Various alterations and modifications will become apparent to those skilled in the art without departing from the scope and spirit of this invention and it is understood this invention is limited only by the following claims.

What is claimed is:

1. A system for mitigation of induced acceleration to an occupant of a vehicle seat, the system comprising:

a substantially non-deforming structure having a top side with the vehicle seat mounted thereon and a bottom side forming a first portion of a floor of the vehicle; and at least one deformable bracket mounting the non-deforming structure to a second portion of the floor that is separate from the first portion of the floor, wherein the at least one deformable bracket deforms, and the non-deforming structure extends through the second portion of the floor when the vehicle is subjected to an upward force that is equal to or greater than a predetermined force that corresponds to an induced upward acceleration.

2. The system of claim 1 wherein the at least one deformable bracket is mounted to the non-deforming structure such that the height of the non-deforming structure that is extended through the floor when the at least one deformable bracket is fully deformed is less than the distance between the second portion of the floor and a surface on which the vehicle normally operates when wheels and hubs are removed from the vehicle, such that the non-deforming structure does not strike the surface on which the vehicle normally operates.

3. The system of claim 1 wherein the induced acceleration is generated by an explosive event.

4. The system of claim 3 wherein the explosive event is generated by at least one of a land mine, an improvised explosive device (IED), and a booby trap.

5. The system of claim 1 further comprising a seal configured to provide sealing between the first and the second portions of the vehicle floor.

6. The system of claim 5 wherein the seal has a first seal portion mounted to the first portion of the vehicle floor, and a second seal portion mounted to the second portion of the vehicle floor.

7. The system of claim 1 wherein the at least one deformable bracket comprises an accordion-shaped bracket.

8. The system of claim 1 further comprising at least one buffer mounted between the seat and the non-deforming structure, and configured to reduce vibration transmission to the seat occupant.

9. The system of claim 8 wherein the buffer is a resilient material including at least one of rubber, an elastomer, and urethane.

10. The system of claim 1 wherein the non-deforming structure comprises a vehicle battery box.

11. A method of mitigation of induced acceleration to an occupant of a vehicle seat, the method comprising:

mounting the vehicle seat to a top side of a substantially non-deforming structure, wherein the non-deforming structure has a bottom side forming a first portion of a floor of the vehicle; and mounting the non-deforming structure to a second portion of the floor that is separate from the first portion of the floor using at least one deformable bracket, wherein the at least one deformable bracket deforms, and the non-deforming structure extends through the second portion of the floor when the vehicle is subjected to an upward force that is equal to or greater than a predetermined force that corresponds to an induced upward acceleration.

12. The method of claim 11 wherein the at least one deformable bracket is mounted to the non-deforming structure such that the height of the non-deforming structure that is extended through the floor when the at least one deformable bracket is fully deformed is less than the distance between the second portion of the floor and a surface on which the vehicle normally operates when wheels and hubs are removed from the vehicle, such that the non-deforming structure does not strike the surface on which the vehicle normally operates.

13. The method of claim 11 wherein the induced acceleration is generated by an explosive event.

14. The method of claim 13 wherein the explosive event is generated by at least one of a land mine, an improvised explosive device (IED), and a booby trap.

15. The method of claim 11 further comprising providing sealing between the first and the second portions of the vehicle floor.

16. The method of claim 15 wherein the sealing is performed using a seal having a first seal portion mounted to the first portion of the vehicle floor, and a second seal portion mounted to the second portion of the vehicle floor.

17. The method of claim 11 wherein the at least one deformable bracket comprises an accordion-shaped bracket.

18. The method of claim 11 further comprising mounting at least one buffer between the seat and the non-deforming structure to reduce vibration transmission to the seat occupant.

19. The method of claim 18 wherein the buffer is a resilient material including at least one of rubber, an elastomer, and urethane.

20. The method of claim 11 wherein the non-deforming structure comprises a vehicle battery box.

* * * * *